US010190321B2

(12) United States Patent
Li et al.

(10) Patent No.: US 10,190,321 B2
(45) Date of Patent: Jan. 29, 2019

(54) MOUNTING SYSTEM OF A PANEL AND CLIP OF THE SYSTEM

(71) Applicant: Hunter Douglas Architectural Products (China) Ltd., Shanghai (CN)

(72) Inventors: Xiang Li, Shanghai (CN); Yun Sun, Shanghai (CN); Jian Min Li, Shanghai (CN)

(73) Assignee: Hunter Douglas Architectural Products China Ltd., Shanghai (CN)

( * ) Notice: Subject to any disclaimer, the term of this patent is extended or adjusted under 35 U.S.C. 154(b) by 0 days.

(21) Appl. No.: 15/293,923

(22) Filed: Oct. 14, 2016

(65) Prior Publication Data

US 2017/0107724 A1 Apr. 20, 2017

(30) Foreign Application Priority Data

Oct. 15, 2015 (CN) ..... 2015 1 0662517
Oct. 15, 2015 (CN) ..... 2015 2 0794243 U

(51) Int. Cl.
*E04F 13/08* (2006.01)
*E04F 13/12* (2006.01)
*E04F 13/14* (2006.01)

(52) U.S. Cl.
CPC ..... *E04F 13/0826* (2013.01); *E04F 13/0814* (2013.01); *E04F 13/12* (2013.01); *E04F 13/14* (2013.01)

(58) Field of Classification Search
CPC ... E04F 13/0828; E04F 13/0826; E04F 13/14; E04F 13/0814; E04F 13/12; E04F 13/0889; E04F 13/0846; E04F 13/0862; E04F 13/0801; E04B 2002/7462; E04B 2002/7466
See application file for complete search history.

(56) References Cited

U.S. PATENT DOCUMENTS 3,342,005 A * 9/1967 Rickards ..... E04F 13/0846 52/378
3,405,493 A * 10/1968 Omholt ..... E04F 13/0826 52/402
5,076,034 A * 12/1991 Bandy ..... E04B 2/967 52/204.591

(Continued)

FOREIGN PATENT DOCUMENTS

DE 10205623 A1 9/2003
DE 102005044322 A1 4/2007

(Continued)

*Primary Examiner* — Adriana Figueroa
*Assistant Examiner* — Jessie T Fonseca
(74) *Attorney, Agent, or Firm* — Dority & Manning, P.A.

(57) ABSTRACT

The present invention provides a mounting system for a panel, comprising: a clip, a sub-frame, a spacer and a resilient washer, wherein the clip and sub-frame are secured by a screw going through a round hole of the clip, the wing and a hole of the sub-frame. The mounting clip has the following characteristics: reducing the number of clips because clips may be used for both horizontal and vertical mountings of the ceramic panel; the clips are not exposed; the resilient contact between the clips and panels; panels are not vulnerable to come off; the clips can satisfy the separate mounting and removal for panels.

20 Claims, 13 Drawing Sheets

(56) References Cited

U.S. PATENT DOCUMENTS

| | | | | |
|---|---|---|---|---|
| 5,839,236 | A * | 11/1998 | Frey | E04B 2/965 52/235 |
| 6,315,489 | B1 * | 11/2001 | Watanabe | E04F 13/0846 248/220.21 |
| 6,460,311 | B1 * | 10/2002 | Ito | E04F 13/0826 52/489.1 |
| 6,843,032 | B2 * | 1/2005 | Hikai | E04F 13/0846 52/287.1 |
| 6,990,778 | B2 * | 1/2006 | Passeno | E04F 13/0862 52/385 |
| D570,671 | S * | 6/2008 | Hikai | D8/382 |
| 7,918,065 | B2 * | 4/2011 | Ito | E04F 13/0826 52/489.1 |
| 8,402,707 | B2 * | 3/2013 | Mitchell | E04C 2/38 52/287.1 |
| 8,429,868 | B2 * | 4/2013 | Minami | E04F 13/0828 52/235 |
| 2001/0047637 | A1 | 12/2001 | Henderson et al. | |
| 2002/0020130 | A1 | 2/2002 | Hikai | |
| 2002/0046536 | A1 * | 4/2002 | Hotta | E04F 13/0846 52/698 |
| 2002/0046546 | A1 * | 4/2002 | Ito | E04F 13/0846 52/802.11 |
| 2002/0095889 | A1 | 7/2002 | Hikai | |
| 2008/0216444 | A1 * | 9/2008 | Loyd | E04F 13/0803 52/742.16 |
| 2010/0132295 | A1 * | 6/2010 | Bootier | E04F 13/0841 52/520 |
| 2010/0251647 | A1 * | 10/2010 | Enns | E04F 13/081 52/302.1 |
| 2012/0186170 | A1 * | 7/2012 | Macdonald | E04F 13/0805 52/173.3 |

FOREIGN PATENT DOCUMENTS

| | | | | |
|---|---|---|---|---|
| EP | 1182306 | A2 | 2/2002 | |
| EP | 1878847 | A2 | 1/2008 | |
| KR | 101421965 | B1 | 7/2014 | |
| WO | WO 2004079127 | A1 * | 9/2004 | E04F 13/0808 |
| WO | 2006064268 | A1 | 6/2006 | |
| WO | 2006/078226 | A1 | 7/2006 | |
| WO | WO 2006097551 | A1 * | 9/2006 | E04F 13/0826 |
| WO | 2008/097158 | A1 | 8/2008 | |

* cited by examiner

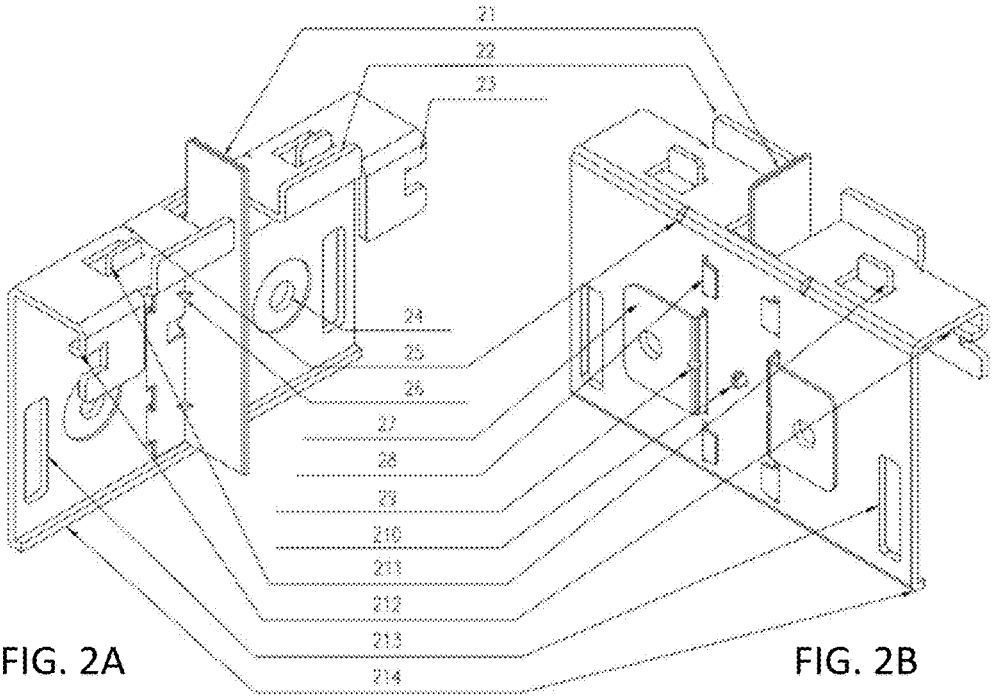
FIG. 2A
FIG. 2B
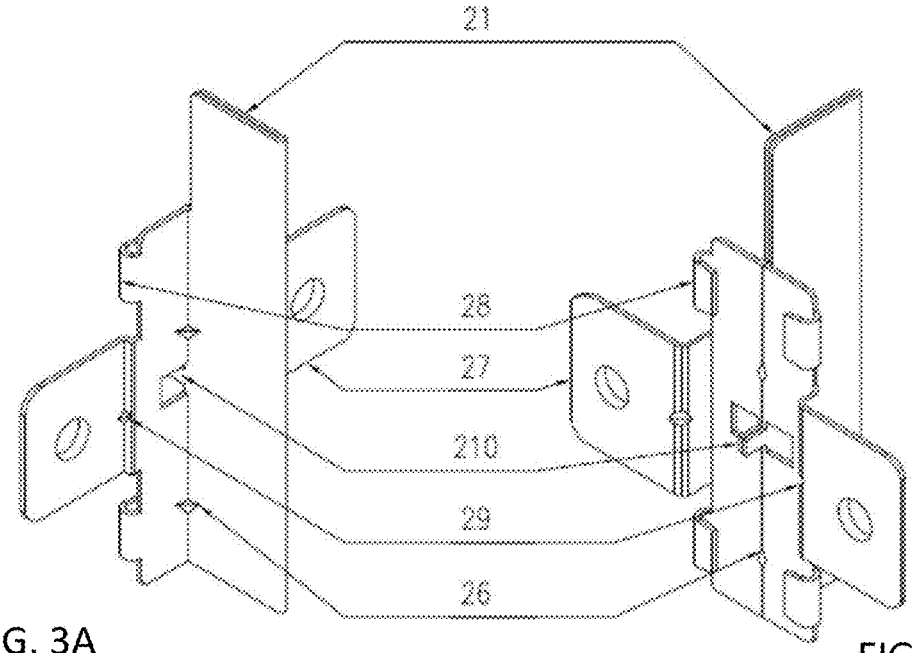
FIG. 3A
FIG. 3B

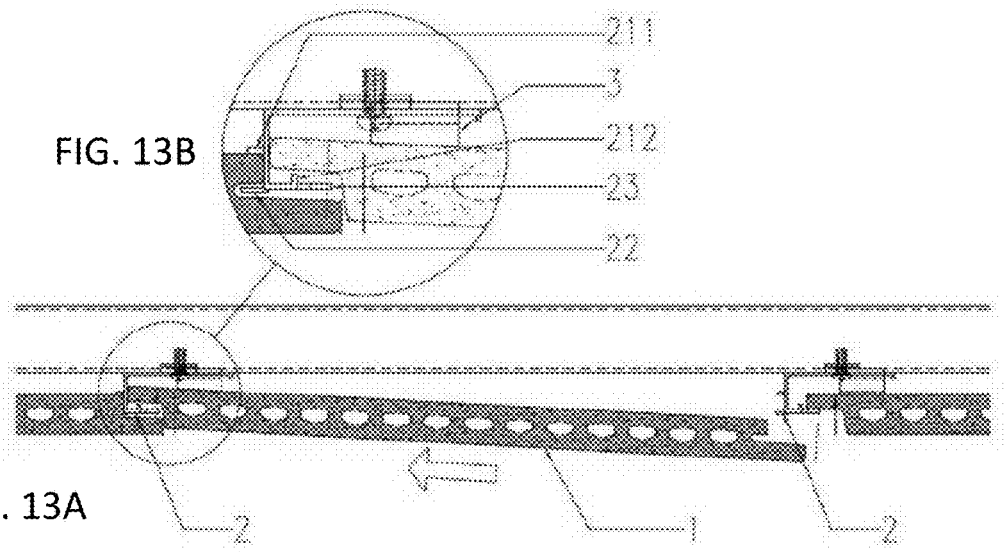
FIG. 13B
FIG. 13A
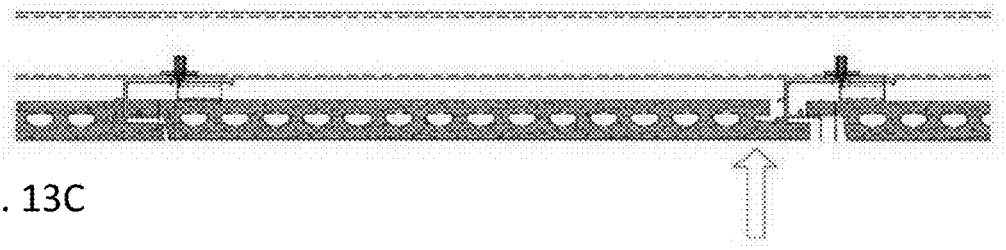
FIG. 13C
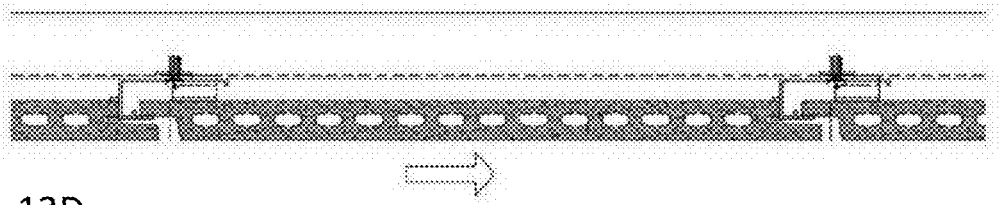
FIG. 13D

MOUNTING SYSTEM OF A PANEL AND CLIP OF THE SYSTEM

CROSS-REFERENCE TO RELATED APPLICATIONS

This application claims priority to Chinese Patent Application No. 201510662517.1 filed Oct. 15, 2015 and Chinese Utility Model Patent Application No. 201520794243.7 filed Oct. 15, 2015, which are hereby incorporated by reference herein in their entireties for all purposes.

TECHNICAL FIELD

The present application relates to a mounting system of a panel and a clip of the system, fit for decoration of interior or exterior walls, especially decorative walls such as single panels of metal, honeycomb panels, isolation panels and ceramic panels.

BACKGROUND TECHNOLOGY

In the field of wall panel decoration (including interior and exterior walls) of buildings, the following problems will frequently occur in the aspects (such as stability, security and decoration effects and mounting convenience) of a mounting system: a clip cannot absorb the impulsive force exerted thereon or prevent a panel from falling off; a clip is exposed and has a poor appearance; seams have widths that are not uniform; a clip cannot be employed both in horizontal mounting and vertical mounting orientations the clip can hardly allow the panels to be separately mounted or to be separately removed; a relatively large number of clips, and too many mounting steps for mounting the clips are required; positioning accuracy of clips is not high. Due to these potential difficulties, mounting quality cannot be guaranteed, decorative effects would be poor and finished products are difficult to maintain with relatively high cost in mounting.

CONTENT OF INVENTION

In the first aspect, the present invention provides a clip for a mounting system of panels, the clip comprising: a body of the clip; a positioning means disposed on the body for securing the clip relative to a rail of the mounting system; an upper side extending from the body, comprising: at least one first upper flange protruding upwardly, and a second upper flange parallel to the first upper flange and spaced a distance towards the body; at least one first lower flange protruding downwardly, and a second lower flange extending from the first lower flange towards the body, a baffle perpendicular to the first upper flange, the baffle secured to and protruding from the body.

Preferably, the number of the first upper flange, the second upper flange, the first lower flange and the second lower flange is two, and the baffle is located in the center of the two first upper flanges. A mounting hole is at two sides of the body for accommodating a resilient washer. The positioning means is configured as two recessed round hole and wing at the opposite side of the body, wherein the round hole is aligned with a through hole of the corresponding wing so as to allow a screw to pass therethrough.

In one embodiment, the baffle includes a positioning plate inserting into the body of the clip and a hook going through the body such that the hook is secured at the opposite side of the body. A reinforcing rib is at corner of the body and the upper side and at corner of the wing. A flexing edge extends from the body and opposite to the upper side.

In the second aspect, the present invention provides a sub-frame for mounting system of a panel, wherein the sub-frame comprises a substantial C-shaped cross-section, comprising: a bottom face with mounting holes so as to connect with a base frame of the mounting system, and a front face forming a rail, wherein holes are disposed at guiding rails of the rail. (amendment accepted) Preferably, the bottom face includes a groove. The mounting holes are equidistantly configured and the holes are aligned and equidistantly configured on the guiding rails.

In the third aspect, the present invention provides a spacer for mounting system of a panel comprising a substantial C-shaped cross-section, a mounting groove forming at an opening portion for clipping onto a baffle of the mounting system. Preferably, the mounting groove is in sawtooth shape.

Also in the third aspect, the present invention provides a resilient washer for mounting system of a panel formed by two substantial O-shaped cross-sections, and a mounting groove is disposed at one of the two cross-sections for fitting onto a clip of the mounting system. Preferably, the washer is formed by EPDM.

In the fourth aspect, the present invention provides a mounting system for a panel, comprising: a clip, a sub-frame, a spacer, and a resilient washer, wherein the clip and sub-frame are secured by a screw going through a round hole of the clip, the wing and a hole of the sub-frame.

In the fifth aspect, the present invention provides a method for assembling a mounting system, comprising: fixing the sub-frame to the base frame; clipping the spacer onto the baffle of the clip; inserting the wing of the clip into underneath of the guiding rails of the sub-frame, and rotating the clip such that the round hole of the clip, the wing and the hole of the sub-frame are aligned; causing a screw to go through the round hole of the clip, the wing and the hole of the sub-frame for fixing; and installing the resilient washer onto an mounting hole of the clip.

The sub-frame is fixed with the base frame vertically.

The mounting system of the present invention may be used for metal single panels of metal, metal honeycomb panels, metal isolation panels, and ceramic panels. It is understandable that the mounting system of the present invention may also be applied to other panels that are not enumerated here one by one. The mounting system of the present invention, with components of different shapes in cooperation, is capable of solving aforesaid many defects and fulfilling the installation of multi-purpose decorative panels. Especially, the clip is fit for mounting systems of several specifications and types, and may be used both in horizontal mounting and vertical mounting of said panels, with changing decorative effects, convenient Installation and detachment, high stability and security of the system. Such a novel clip has addressed the problems easily found in a mounting system during wall panel mounting from the angle of configuration, as a result of which the installation effect and quality of decorative panels are guaranteed.

BRIEF DESCRIPTION OF FIGURES

Referring to the figures, the present invention is described by means of non-limited examples below:

FIGS. 2A and 2B illustrate a clip of mounting system of the present invention;

FIGS. 3A and 3B illustrate a baffle matching the clip;

FIGS. 13A-13D illustrate mounting the ceramic panel vertically to the clip;

SPECIFIC EMBODIMENT

The part of embodiments describes the employment of the mounting system of the present invention to install a ceramic panel. To those skilled in the art, the mounting system of the present invention as well as other components may be applied to the installation of decorative panels of other types.

Figure 1:
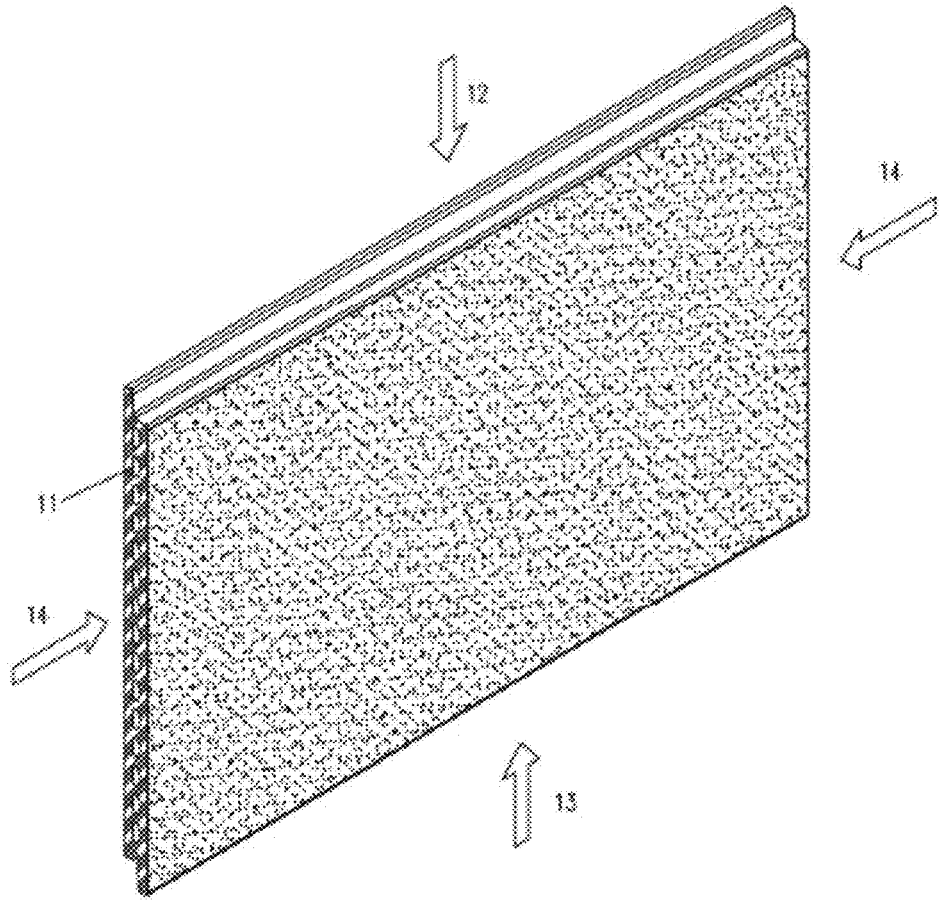
FIG. 1 illustrates a known ceramic panel.

A known ceramic panel 1, as shown in FIG. 1, has a plurality of sections of hollow drying holes 11, extruded edges 12, extruded grooves 13 and cut edges 14, with its thickness ranging from 15 mm-100 mm and width ranging from 100 mm-1000 mm, and with a mounting edge being the extruded edge of the ceramic panel. And, no slots and holes are necessary to be made when field installation.

Referring to FIGS. 2A and 2B, a body of a clip 2 is basically a sheet formed by steel stamping, the top of which comprises two first upper flanges 22 protruding upward that may be configured to bent-up hooks 22. On the top of the clip, two upper second flanges 211 restricting the ceramic panel's forward and backward shift may be configured to be restricting hooks 211 that are parallel with the first upper flange, and, are spaced at a certain distance toward the body, for receiving the ceramic panel between the first and second upper flanges during installation.

Two lower flanges 23 protruding downward may be configured to be bent-down hooks. And, second lower flanges 212, extending from the first lower flanges to the body, may be configured to be position-limiting hooks 212. Preferably, the position-limiting hooks 212 extend from the lateral face of the first lower flanges 23 vertically to the body, for supporting the ceramic panel during installation.

Referring to FIGS. 3A and 3B, an intermediate vertical baffle 21 is preferably positioned at the right center between the two first upper flanges, which, during horizontal installation, may be used for limiting seams and positioning and for supporting the ceramic panel during vertical installation. The vertical baffle 21 comprises a base having four fixing hooks 28 going through the body, and two wings 27 going through the body and stretching toward two sides.

The body of clip is also provided with two sunk round holes 24 for the penetration of machine screws during installation, so as to be secured onto a sub-frame. The round holes 24 are aligned with the corresponding wings 27 to allow screws to go through.

Two convex ribs 25 are provided at corners of the upper lateral face of the body of the clip, and one convex rib 29 is set at the corner of the wing 27, to increase the strength of the clip. And, four convex ribs 26 are provided on the left and right sides of the vertical baffle 21.

The vertical baffle's back side is provided with a positioning member 210, and is fit into the corresponding hole of the clip's body for positioning. On the lower side of the clip's body has a lower edge configured to be an edge fold 214. And, the two sides of the clip respectively have one resilient washer mounting hole 213.

Figure 4:
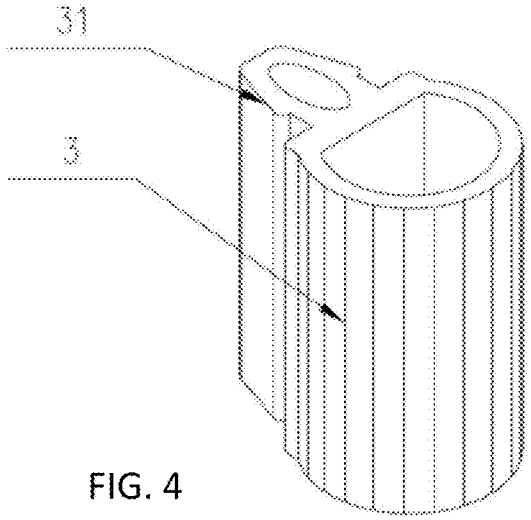
FIG. 4 illustrates a resilient washer of mounting system of the present invention.

FIG. 4 illustrates a resilient washer 3 configured to have two substantial O-shaped cross-sections, one of which has a mounting groove 31 that may be configured to be a tapered mounting leg for being mounted to the resilient washer mounting hole 213 of the clip. The resilient washer 3 is formed by EPDM, which not only makes the ceramic panel in flexible contact with the clip to prevent the ceramic panel from shocking, but also absorbs external impulsive force to protect the ceramic panel.

Figure 5A:
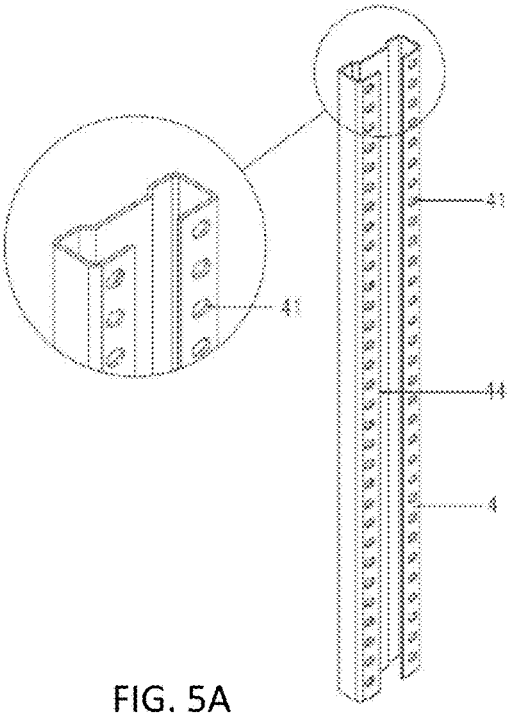
FIGS. 5A and 5B illustrate a sub-frame of mounting system of the present invention.
Figure 5B:
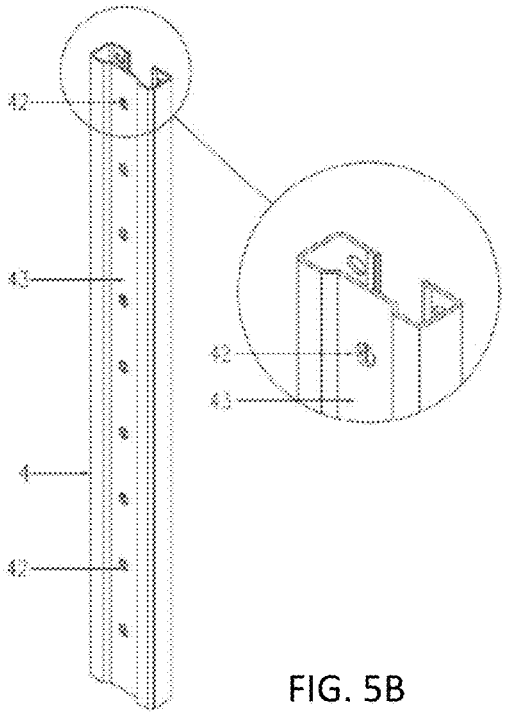

FIGS. 5A and 5B illustrate a mounting sub-frame 4 stamped by steel roll and having a substantial C-shaped cross-section. The front face of the sub-frame forms a rail and has oval holes 41 provided on its two sides for securing the clip 2 and ensuring the accurate installation of the clip. And, the bottom face of the sub-frame are provided with prefabricated mounting holes 42 for connecting a base frame of the mounting system, as well as a groove 43 for increasing the sub-frame's anti-twist function.

Figures 6A, 6B:
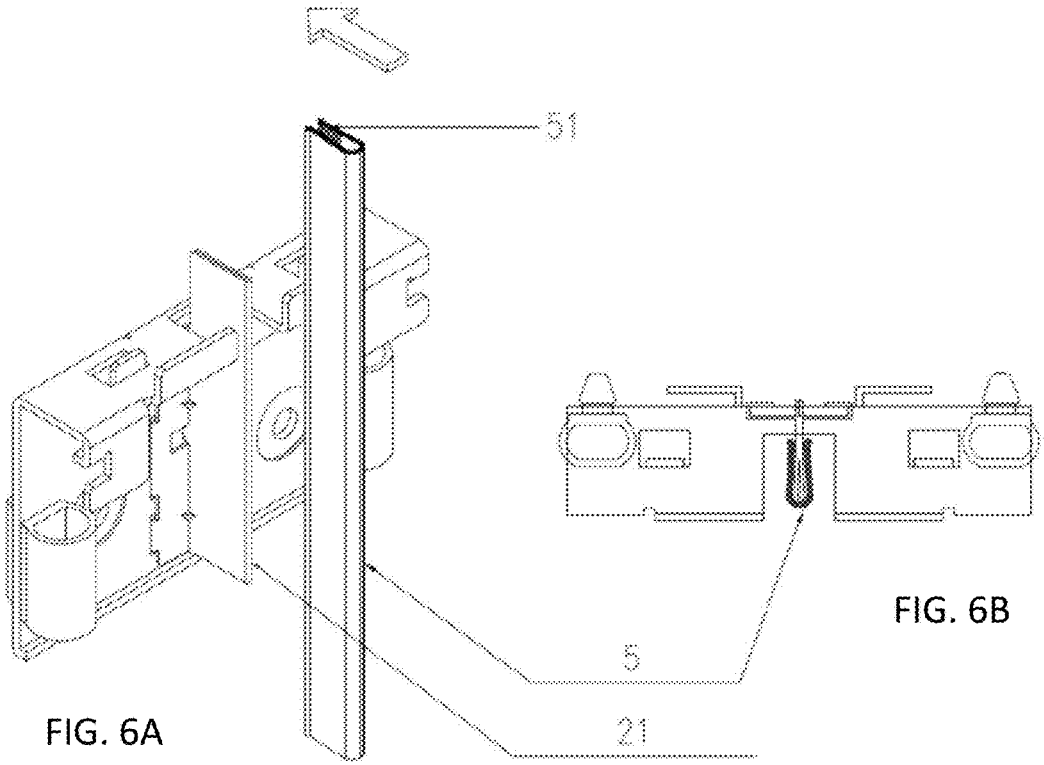
FIGS. 6A and 6B illustrate a spacer, and a sketch of the completed installation of the clip, baffle and spacer.
Figure 7A:
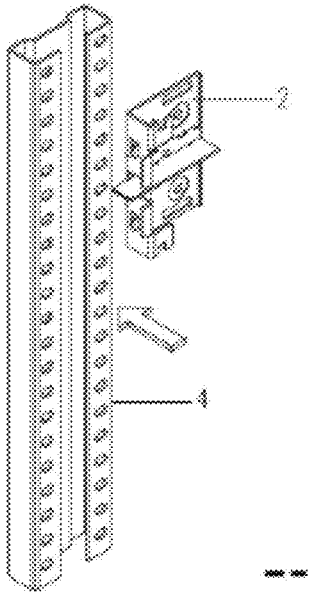
FIGS. 7A-7D illustrate the assembly of the clip and sub-frame during the horizontal installation of the ceramic panel.
Figure 7B:
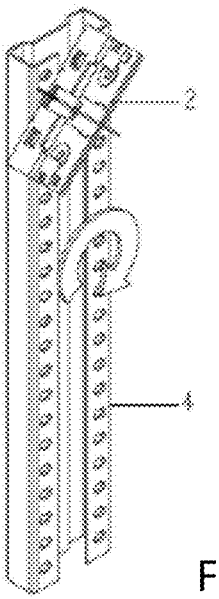
Figure 7D:
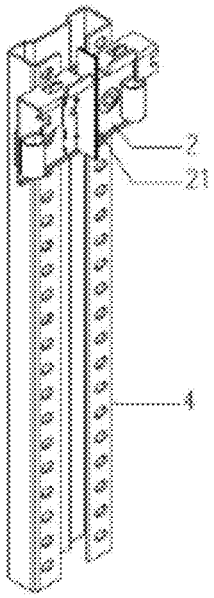
Figure 7C:
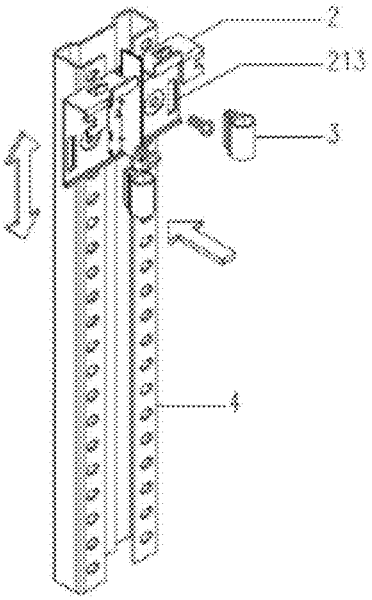

FIGS. 6A and 6B illustrate a spacer 5 made of a black PVC material and having a substantial C-shaped cross-section, with mounting groove 51 in sawtooth shape set at the opening portion for clipping onto the vertical baffle 21.

Horizontal Installation of Ceramic Panel

Figure 8:
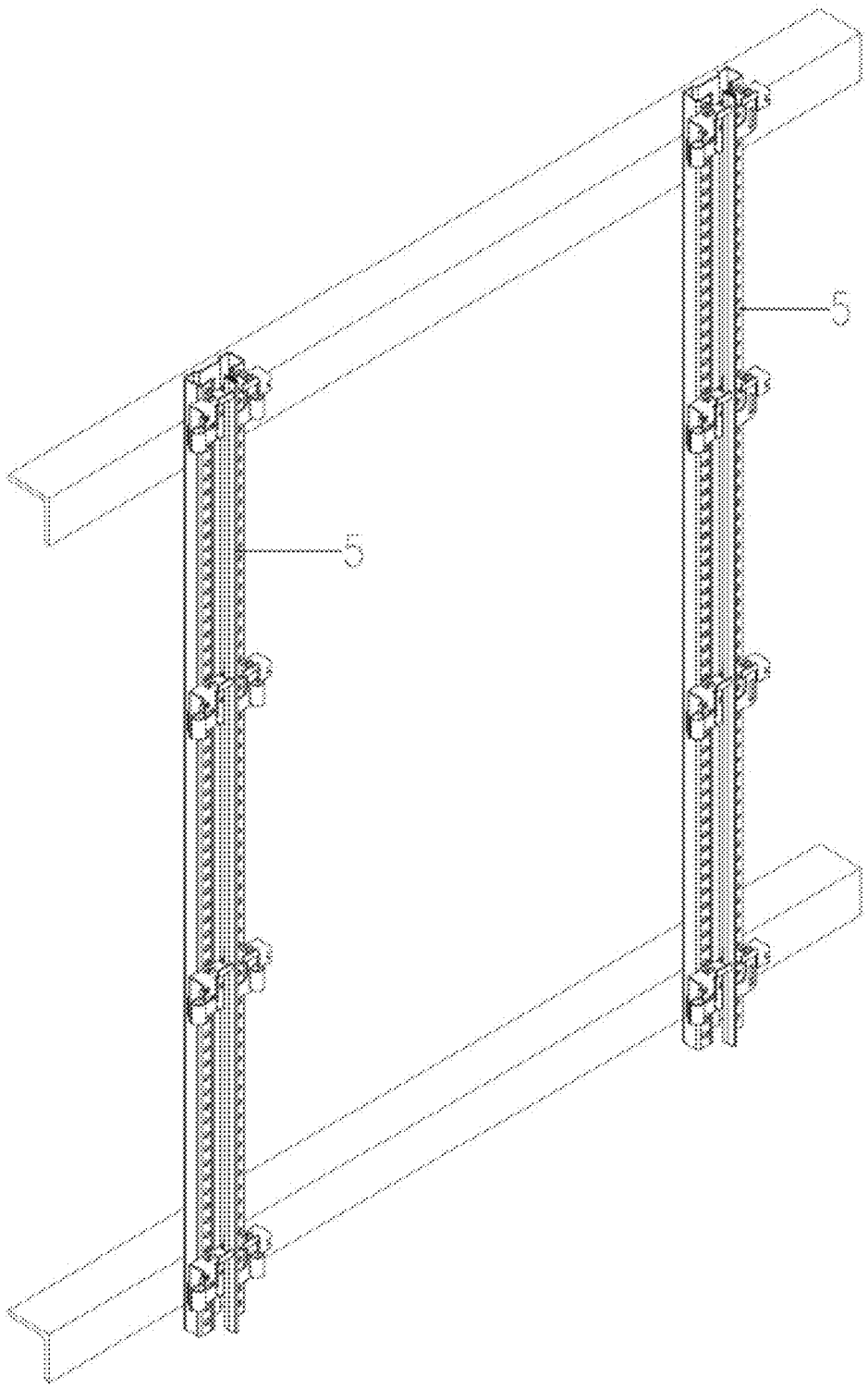
FIG. 8 illustrates the assembly of the spacer and clip during the horizontal installation of the ceramic panel.

The sub-frame 4 is vertically mounted onto a base frame, and is secured onto the base frame by screw. Referring to FIGS. 7A-7D, according to the arrow, the clip 2 is fit onto a sub-frame rail, from FIG. 7A to FIG. 7B and from FIG. 7B to FIG. 7C, and the wing 27 goes through the sub-frame opening into the cavity of the sub-frame. The wing 27 is inserted between and underneath the sub-frame rails. The clip clings closely to the sub-frame and rotates 90 degrees to make the wing 27 be held within the cavity of the sub-frame 4 under the sub-frame rails and thereby clipping into the sub-frame 4. And, the clip 2 is slid along the rail to a pre-set position such that the round hole 24 of the clip 2, the wing 27 and the oval hole 41 of the sub-frame are aligned, and the clip 2 is secured onto the sub-frame 4 by machine screws; resilient washers 3 are fit onto the resilient washer mounting holes 213 on the two sides of the clip 2. Referring to FIG. 8, a spacer 5 is clipped onto the baffle 21. Then, the installation of a clip is completed.

Figure 9A:
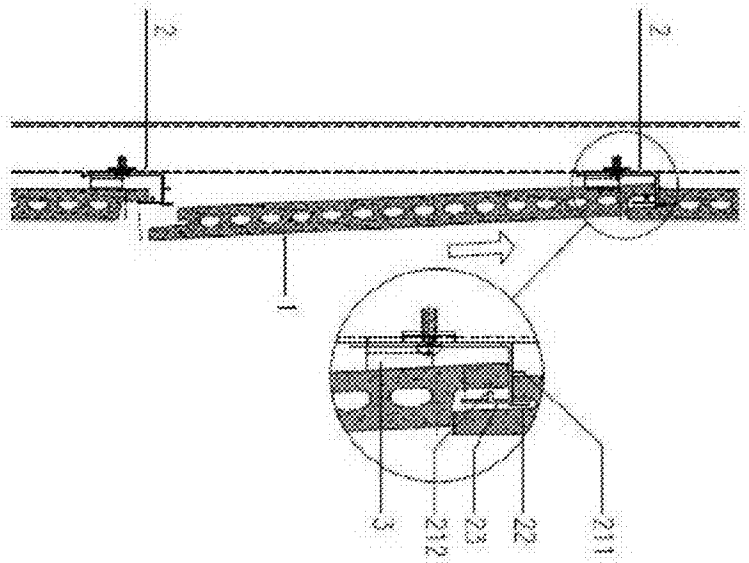
FIGS. 9A-9C illustrate mounting the ceramic panel horizontally to the clip.
Figure 9B:
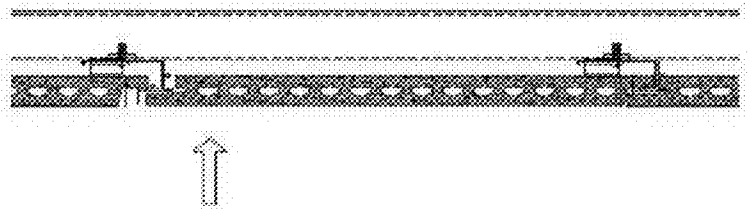
Figure 9C:
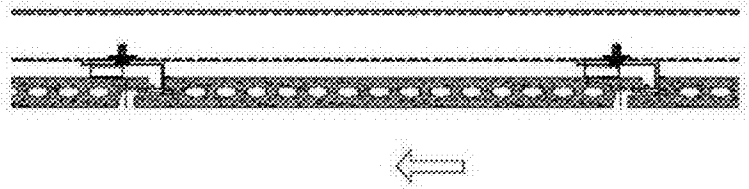
Figure 10:
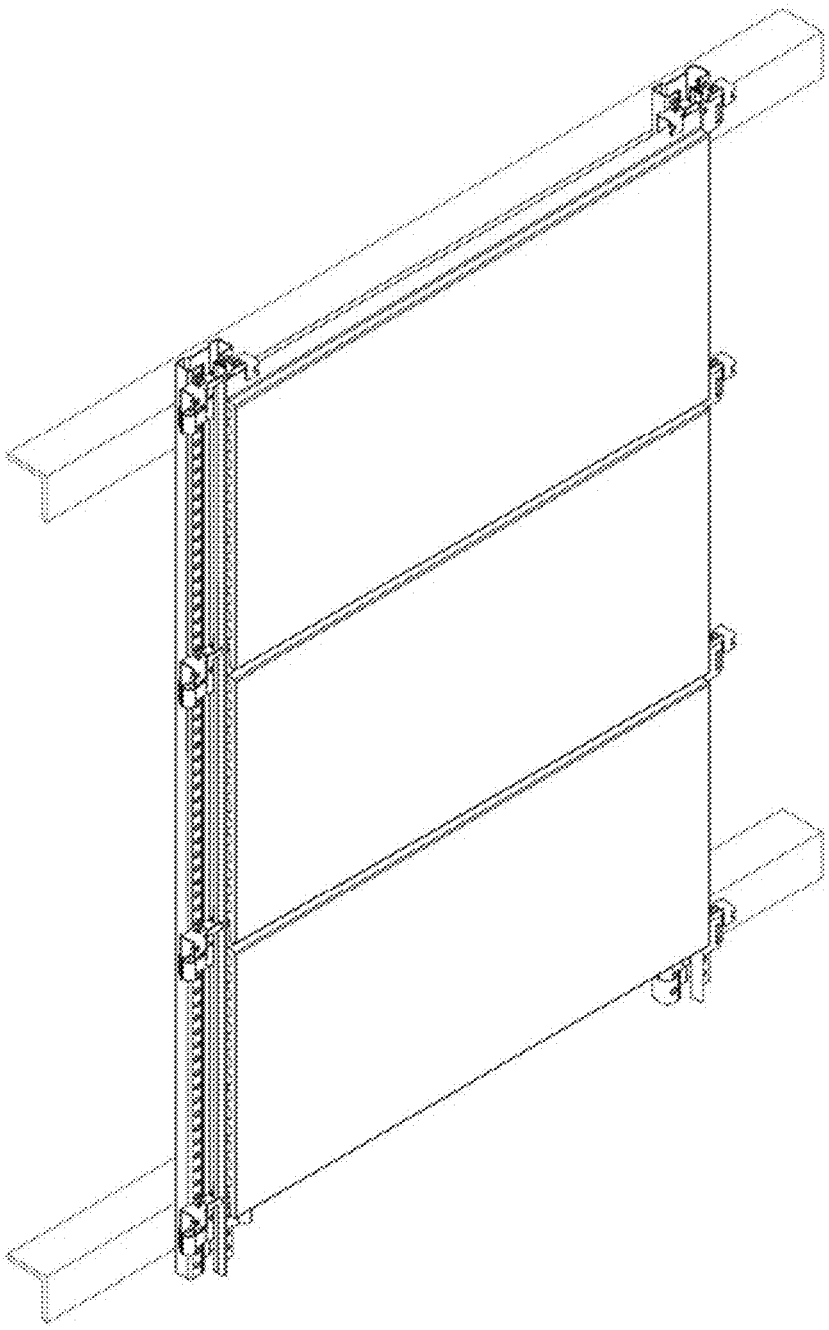
FIG. 10 illustrates the ceramic panel installed horizontally.
Figure 11A:
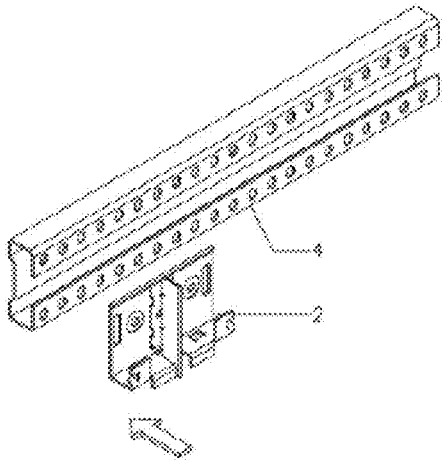
FIGS. 11A-11D illustrate the assembly of the clip and sub-frame during the vertical installation of the ceramic panel.
Figure 11B:
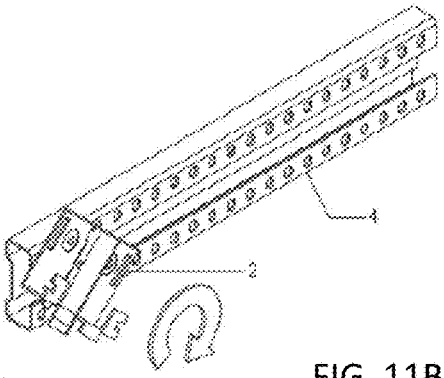
Figure 11D:
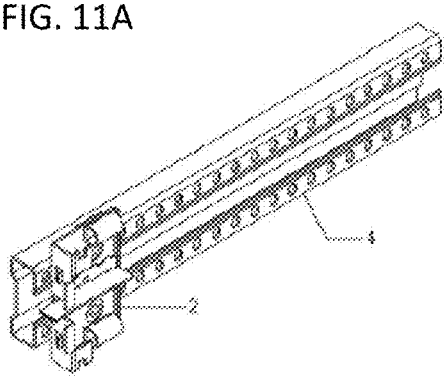
Figure 11C:
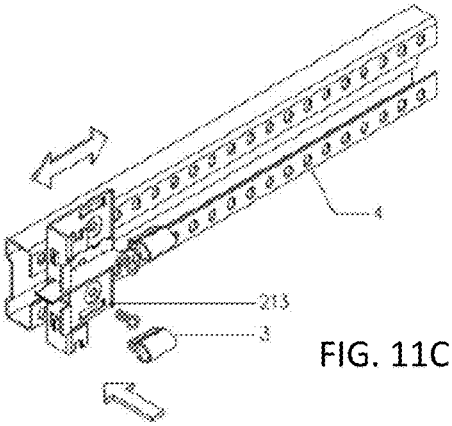

Subsequently, the installation of a ceramic panel 1 is started. Referring to FIGS. 9A-9C, a relatively long extruded edge of the upper side of the ceramic panel 1 is inserted upwardly between a bent-down hook 23 of a first clip (the upper clip relative to the second clip at the lower side) and a body, which is against a resilient washer 3 to make the resilient washer 3 in a pressed state. Next, a relatively short extruded edge of the lower side of the ceramic panel 1 is inserted between a bent-up hook 22 of a second clip (the lower clip relative to the first clip at the upper side as mentioned above) and a second upper flange 211, supported on the second clip. Moreover, with the horizontal position of the ceramic panel 1 being adjusted properly, the left/right side of the ceramic panel is made against the baffle 21. Then, the installation of the ceramic panel is completed (see FIG. 10).

Vertical Installation of Ceramic Panel

Figure 12:
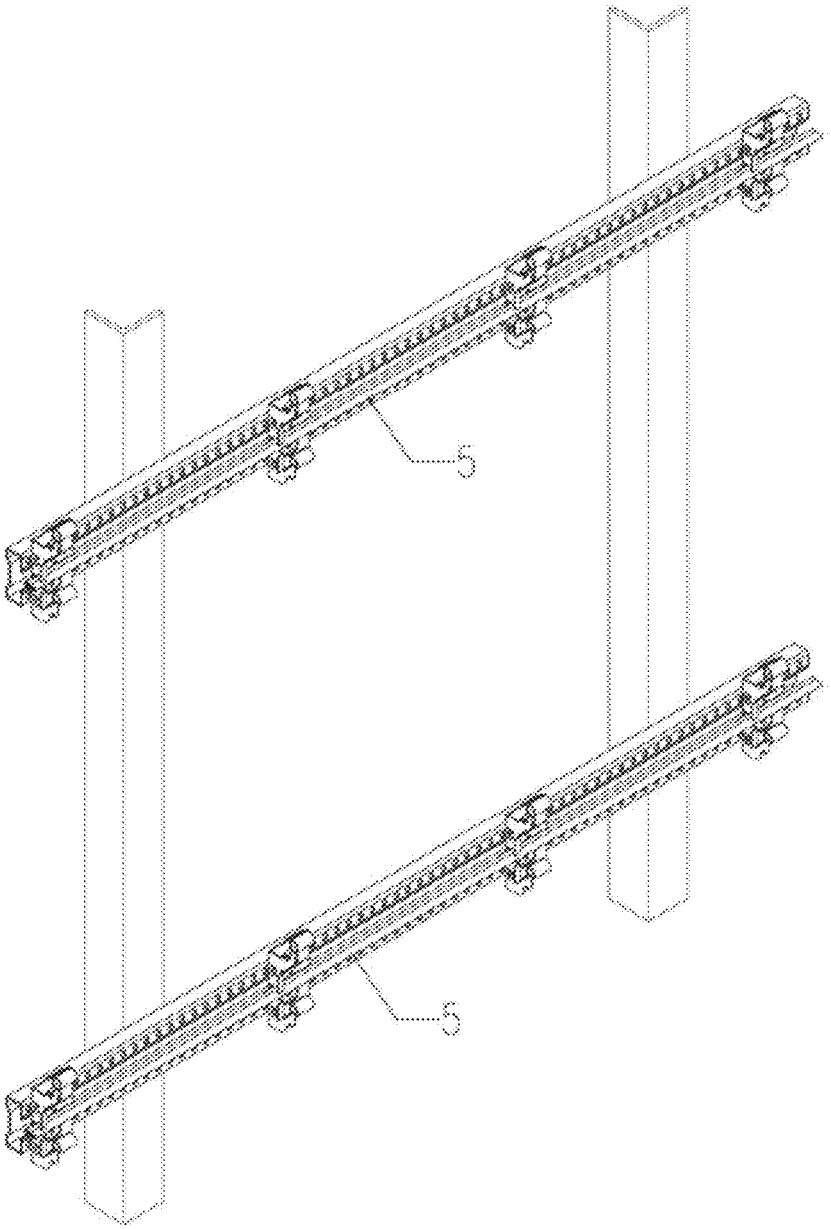
FIG. 12 illustrates the assembly of the spacer and clip during the vertical installation of the ceramic panel.

A sub-frame 4 is horizontally mounted onto a base frame, and is secured onto the base frame by screw. Referring to FIGS. 11A-11D, according to the arrow, the clip 2 is fit onto a sub-frame rail, from FIG. 11A to FIG. 11B and from FIG. 11B to FIG. 11C, and the wing 27 goes through the sub-frame opening into the cavity of the sub-frame. The clip clings closely to the sub-frame and rotates 90 degrees to make the wing 27 clip onto the sub-frame 4. And, the clip 2 is slid along the rail to a pre-set position, and is secured onto the sub-frame 4 by machine screw; resilient washers 3 are fit onto the resilient washer mounting holes 213 on the two sides of the clip 2. Referring to FIG. 12, a spacer 5 is clipped onto the baffle 21. Then, the installation of the clip is completed.

Figure 14:
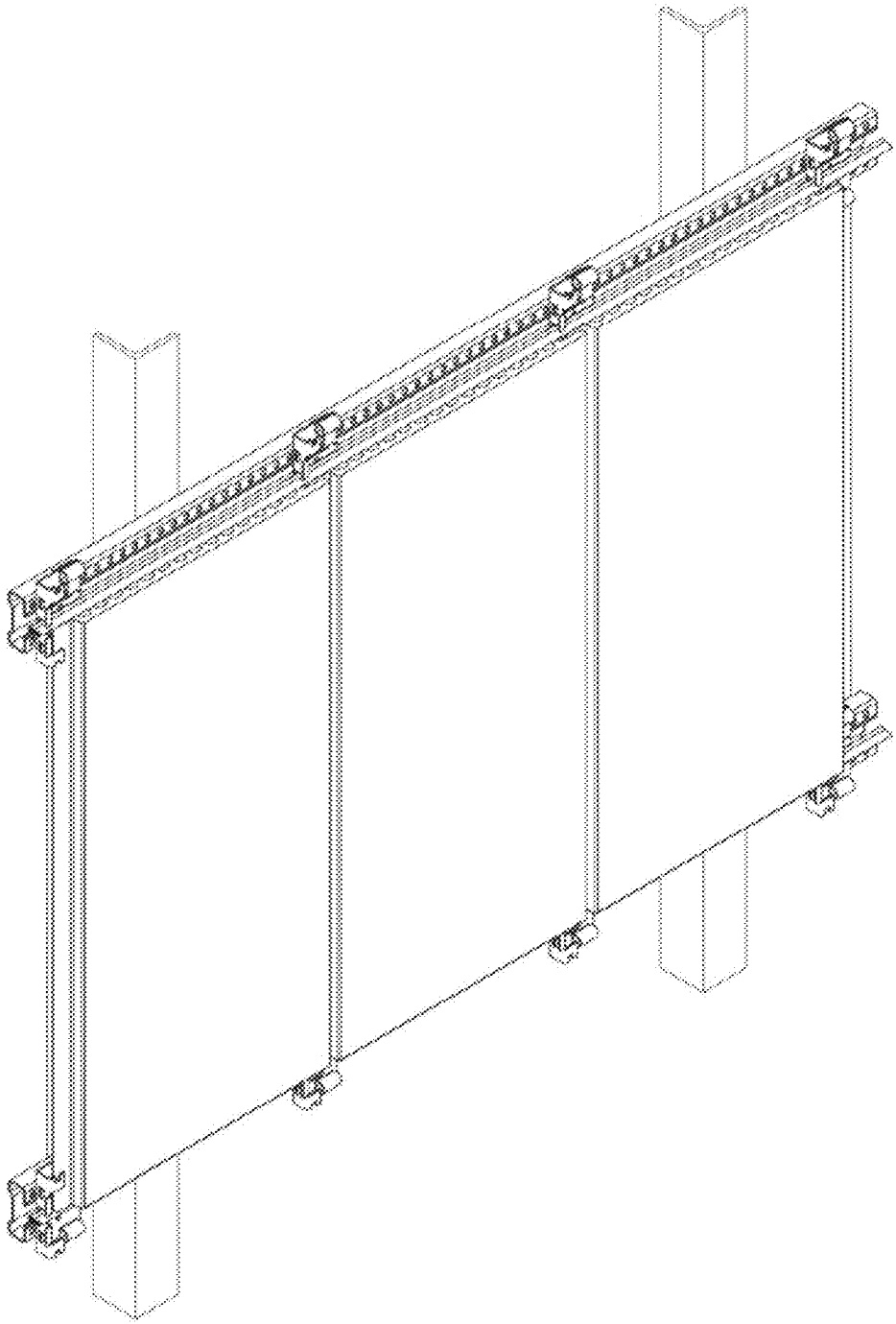
FIG. 14 illustrates the ceramic panel installed vertically.

Subsequently, the installation of a ceramic panel 1 is started. Referring to FIGS. 13A-13D, a relatively long extruded edge of the left side of the ceramic panel 1 is inserted between a bent-down hook 23 of a first clip (the left-side clip relative to the right-side clip) and a body, which is against a resilient washer 3 to make the resilient washer 3 in a pressed state. Next, a relatively short extruded edge of the right side of the ceramic panel 1 is inserted between a bent-up hook 22 of a second clip (the right-side clip relative to the left-side clip as mention above) and a second upper flange 211, with a cut edge on the lower side of the ceramic panel 1 supported on the baffle 21. Moreover, with the horizontal position of the ceramic panel 1 being adjusted properly, the extruded edges of the two sides are limited in proper positions without a risk of escape. Then, the installation of the ceramic panel is completed (see FIG. 14).

By different mounting orientation, the mounting clip of the present invention meets both horizontal and vertical decoration arrangements for a ceramic panel, which is universally applicable to both horizontal mounting and vertical mounting for a ceramic panel. And, the installation is completed with only one clip required at a horizontal-vertical joint seam of ceramic panels, wherein the number of clips is economized relative to a conventional mounting system of ceramic panels that requires a plurality of clips.

Figure 15:
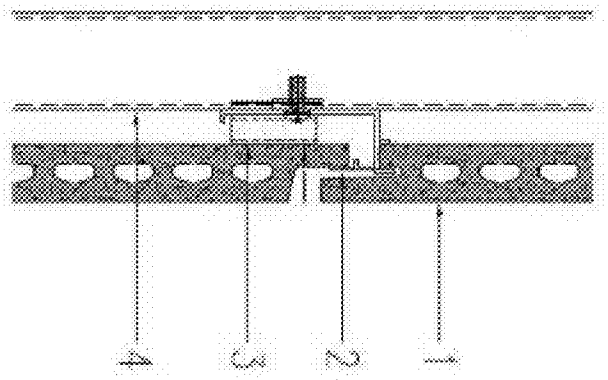
FIG. 15 illustrates the clip's condition not observable from the outside after the installation is completed.

The clip is not exposed, and cannot be observed from the outside after the completion of installation, which prevents the exposure of a clip and will not affect aesthetics (see FIG. 15).

Figure 16:
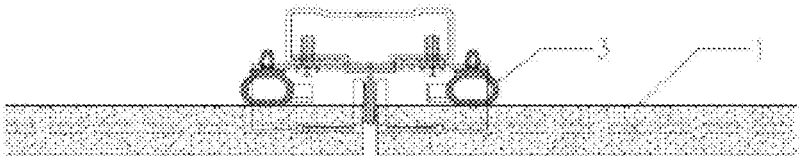
FIG. 16 illustrates a flexible contact between the resilient washer and ceramic panel.

The clip contacts a ceramic panel by a resilient washer flexibly. With pre-set resilient washer mounting holes on the clip, various specifications of resilient washers may be fit to ensure the resilient washers to be in a pressed state after the installation of the ceramic panel is completed. While the requirement of the flexible contact between the ceramic panel and clip is met, external impulsive force exerted on the ceramic panel will also be absorbed (see FIG. 16).

Figure 17:
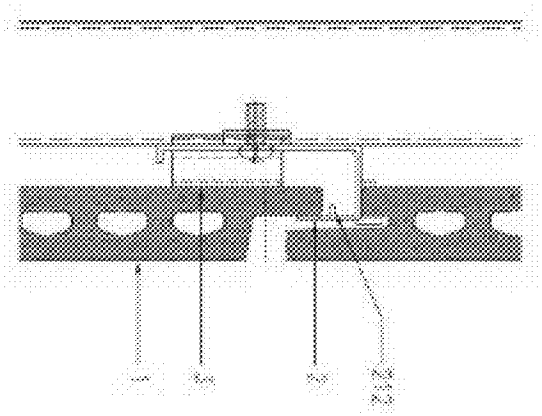
FIG. 17 illustrates a position-limiting hook preventing the ceramic panel from falling off.

The ceramic panel is not easy to fall off. The resilient washer fit on the clip is in a pressed state after the ceramic panel is positioned, which not only absorbs external shock loads, but also increases the friction force between ceramic panels. Meanwhile, the position-limiting hook 212 is set at the bent-down hook of the clip, which may prevent the ceramic panels from falling off when shocked and guarantee the system's security and stability (see FIG. 17).

The ceramic panel may be mounted or detached separately. In the horizontal and vertical decoration arrangements, each ceramic panel may be mounted separately by inserting an extruded edge into a clip; otherwise, each ceramic panel may also be detached by withdrawing an extruded edge from the clip. Both of the installation and detachment of the ceramic panel may be completed separately to facilitate installation and replacement.

Obvious to those skilled in the art, the present invention has a plurality of transformations without deviation from its scope. Especially, the mounting system of the present invention may be used for metal single panels of metal, metal honeycomb panels, metal isolation panels, and ceramic panels, which is not restricted only for the ceramic panel illustrated in the embodiments.

In the entire description and the claim set, unless there are other requirements in context, the word "comprise" as well as its variants (such as "comprises" and "comprising") will be understood to mean including the entirety or step, or a group of entireties or steps, without other entirety or step, or other group of entireties or steps, excluded.

Any previous technical published matter (or its derived information) referenced in this description, or any known problem, will not, and should not, be taken as an acknowledgement, an approval or any other form of suggestion. And, the previous technical published matter (or its derived information) or the known problem constitutes a part of general knowledge in the technical field that this description concerns.

What is claimed is:

1. A mounting system for a panel, mounting system comprising:

a clip, comprising:

a body;

a positioning feature disposed on the body for securing the clip relative to a sub-frame of the mounting system, the positioning feature comprising at least one hole; and an upper side extending from the body, the upper side comprising:

at least one first upper flange protruding upwardly, and a second upper flange parallel to the first upper flange and spaced a distance towards the body;

at least one first lower flange protruding downwardly, and a second lower flange extending from the first lower flange towards the body; and a baffle perpendicular to the first upper flange, the baffle secured to and protruding from the body;

the sub-frame comprising:

a substantially C-shaped cross-section;

a bottom face with mounting holes so as to connect with a base frame of the mounting system; and a front face forming a rail of the mounting system;

a spacer comprising a substantially C-shaped cross-section, a mounting groove formed at an opening portion for clipping into the baffle of the mounting system; and a resilient washer formed by two substantially O-shaped cross-sections, a mounting groove disposed at one of the two cross-sections for fitting onto the clip of the mounting system;

wherein the clip and the sub-frame are secured by a fastener extending through the at least one hole of the clip and a portion of the sub-frame.

2. The mounting system in accordance with claim 1, wherein the at least one first upper flange comprises two first upper flanges, and the baffle is located between the two first upper flanges.

3. The mounting system in accordance with claim 1, further comprising a mounting hole at two sides of the body for accommodating the resilient washer.

4. The mounting system in accordance with claim 3, wherein the at least one hole comprises two recessed holes and the positioning feature further comprises corresponding wings at the two sides of the body, wherein each recessed hole is aligned with a through hole of the corresponding wing so as to allow the fastener to pass therethrough.

5. The mounting system in accordance with claim 4, further comprising a reinforcing rib at a corner of the body and the upper side and at a corner of each wing.

6. The mounting system in accordance with claim 1, wherein the baffle includes a positioning plate inserted into the body and a hook going through the body such that the hook is secured at the opposite side of the body.

7. The mounting system in accordance with claim 1, further comprising a flexing edge extending from the body and opposite to the upper side.

8. The mounting system in accordance with claim 1, wherein the bottom face of the sub-frame includes a groove.

9. The mounting system in accordance with claim 1, wherein the mounting holes are equidistantly configured and further comprising holes disposed at guiding rails of the rail of the mounting system, the holes being aligned and equidistantly configured on the guiding rails.

10. The mounting system in accordance with claim 1, wherein at least a portion of the mounting groove defines a sawtooth shape.

11. The mounting system in accordance with claim 1, wherein the washer is formed of EPDM.

12. The mounting system in accordance with claim 1, wherein the mounting system is utilized for at least one of the following: metal mono-panel, metal honeycomb panel, metal thermal insulation panel or terracotta cladding panel.

13. A method for assembling a mounting system in accordance with claim 1, comprising:

fixing the sub-frame to the base frame;

clipping a spacer onto the baffle of the clip;

inserting a wing of the clip underneath the guiding rails of the sub-frame, and rotating the clip such that the at least one hole of the clip and the hole of the sub-frame are aligned;

causing the fastener to extend through the at least one hole of the clip and the hole of the sub-frame for fixing the clip to the sub-frame; and installing the resilient washer onto an mounting hole of the clip.

14. A method in accordance with claim 13, wherein the sub-frame is fixed with the base frame vertically.

15. A method in accordance with claim 13, wherein the sub-frame is fixed with the base frame horizontally.

16. A mounting system for a panel, said mounting system comprising:

a clip, comprising:

a body;

a positioning feature disposed on the body for securing the clip relative to a sub-frame of the mounting system, the positioning feature comprising at least one hole; and an upper side extending from the body, the upper side comprising:

at least one upper flange protruding upwardly;

at least one lower flange protruding downwardly; and a baffle perpendicular to the at least one first upper flange, the baffle secured to and protruding from the body; and the sub-frame comprising:

a substantially C-shaped cross-section;

a bottom face with mounting holes so as to connect with a base frame of the mounting system; and a front face forming a rail of the mounting system;

wherein the clip and the sub-frame are secured by a fastener extending through the at least one hole of the clip and a portion of the sub-frame.

17. The mounting system in accordance with claim 16, further comprising a spacer including a substantially C-shaped cross-section, a mounting groove formed at an opening portion for clipping into the baffle of the mounting system.

18. The mounting system in accordance with claim 16, further comprising a resilient washer formed by two substantially O-shaped cross-sections, a mounting groove disposed at one of the two cross-sections for fitting onto the clip of the mounting system.

19. The mounting system in accordance with claim 16, wherein the at least one hole comprises two recessed holes and the positioning feature further comprises corresponding wings at the two sides of the body, wherein each recessed hole is aligned with a through hole of the corresponding wing so as to allow the fastener to pass therethrough.

20. The mounting system in accordance with claim 16, wherein the baffle includes a positioning plate inserted into the body and a hook going through the body such that the hook is secured at the opposite side of the body.

* * * * *